US010184363B2

(12) United States Patent
Wigsten et al.

(10) Patent No.: US 10,184,363 B2
(45) Date of Patent: Jan. 22, 2019

(54) LOST MOTION DIFFERENTIAL VALVE ACTUATION

(71) Applicants: Jacobs Vehicle Systems, Inc., Bloomfield, CT (US); BorgWarner Inc., Auburn Hills, MI (US)

(72) Inventors: Mark M. Wigsten, Lansing, NY (US); Thomas P. Howell, Ann Arbor, MI (US)

(73) Assignees: Jacobs Vehicle Systems, Inc., Bloomfield, CT (US); BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/272,986

(22) Filed: Sep. 22, 2016

(65) Prior Publication Data

US 2017/0081986 A1 Mar. 23, 2017

Related U.S. Application Data

(60) Provisional application No. 62/222,201, filed on Sep. 22, 2015.

(51) Int. Cl.
*F01L 9/02* (2006.01)
*F01L 13/06* (2006.01)
(Continued)

(52) U.S. Cl.
CPC ..... *F01L 9/023* (2013.01); *F01L 1/08* (2013.01); *F01L 1/24* (2013.01); *F01L 1/26* (2013.01);
(Continued)

(58) Field of Classification Search
CPC ... F01L 13/06; F01L 1/08; F01L 2001/34446; F01L 9/02; F01L 9/025; F01L 1/24;
(Continued)

(56) References Cited

U.S. PATENT DOCUMENTS 5,537,976 A 7/1996 Hu
5,680,841 A 10/1997 Hu
(Continued)

FOREIGN PATENT DOCUMENTS

WO 2013103503 A1 7/2013

OTHER PUBLICATIONS

International Search Report, International Patent Application No. PCT/US2016/053098, dated Jan. 5, 2017, 3 pages.
(Continued)

*Primary Examiner* — Mark A Laurenzi
*Assistant Examiner* — Wesley G Harris
(74) *Attorney, Agent, or Firm* — Moreno IP Law LLC

(57) ABSTRACT

In an engine comprising a cylinder having first and second engine valves of a same function type, a system for actuating the first and second engine valves comprises a first and second master pistons that receive first and second valve actuation motions from respective ones of a first and second valve actuation motion source, a first slave piston operatively connected to the first engine valve and configured to hydraulically receive the first valve actuation motions from at least the first master piston and a second slave piston operatively connected to the second engine valve and configured to hydraulically receive the second valve actuation motions from the second master piston. The system further comprises an accumulator and a mode selector valve in hydraulic communication with the first master piston, the first slave piston and the accumulator. The mode selector valve may selectively hydraulically connect the first master piston to the accumulator.

12 Claims, 9 Drawing Sheets

(51) Int. Cl.

| | |
|---|---|
| ***F01L 1/08*** | (2006.01) |
| ***F01L 1/24*** | (2006.01) |
| ***F01L 13/04*** | (2006.01) |
| ***F01L 1/26*** | (2006.01) |
| ***F02D 13/04*** | (2006.01) |
| *F01L 1/344* | (2006.01) |

(52) U.S. Cl.
CPC ..... *F01L 9/02* (2013.01); *F01L 9/025* (2013.01); *F01L 13/06* (2013.01); *F02D 13/04* (2013.01); *F01L 2001/2444* (2013.01); *F01L 2001/34446* (2013.01)

(58) Field of Classification Search
CPC ..... F01L 2001/2444; F01L 9/023; F01L 1/26; F02D 13/04
See application file for complete search history.

(56) References Cited

U.S. PATENT DOCUMENTS 5,746,175 A * 5/1998 Hu ..... F01L 9/021 123/322
6,267,098 B1 * 7/2001 Vanderpoel ..... F01L 9/02 123/321
7,665,432 B2 2/2010 Vanderpoel
9,181,823 B2 10/2015 Melchior
2001/0023671 A1 * 9/2001 Vorih ..... F01L 1/18 123/90.12
2005/0000476 A1 * 1/2005 Vanderpoel ..... F01L 1/24 123/90.12
2005/0126522 A1 6/2005 Ruggiero
2005/0188966 A1 * 9/2005 Ruggiero ..... F01L 1/08 123/568.14
2008/0006231 A1 1/2008 Noss et al.
2013/0319370 A1 12/2013 Yang

OTHER PUBLICATIONS

Written Opinion of the International Searching Authority, International Patent Application No. PCT/US2016/053098, dated Jan. 4, 2017, 8 pages.
International Preliminary Report on Patentability, International Patent Application No. PCT/US2016/053098, dated Mar. 27, 2018, 9 pages.

* cited by examiner

LOST MOTION DIFFERENTIAL VALVE ACTUATION

CROSS-REFERENCE TO RELATED APPLICATION

The instant application claims the benefit of Provisional U.S. Patent Application Ser. No. 62/222,201 entitled "Differential Valve Lift Lost Motion Variable Valve Mechanisms" and filed Sep. 22, 2015.

FIELD

The instant disclosure relates generally to internal combustion engines and, in particular, to systems for the differential actuation of engine valves incorporating lost motion components.

BACKGROUND

Valve actuation in an internal combustion engine is required for the engine to produce positive power, as well as to produce engine braking. During positive power, intake valves may be opened to admit fuel and air into a cylinder for combustion and exhaust valves may be opened to allow combustion gases to escape from the cylinder.

For both positive power and engine braking applications, the engine cylinder intake and exhaust valves may be opened and closed by fixed profile cams in the engine, and more specifically by one or more fixed lobes which may be an integral part of each of the cams. The use of fixed profile cams makes it difficult to adjust the timing and/or amounts of engine valve lift needed to optimize valve opening/closing times and lift for various engine operating conditions (often referred to as variable valve actuation (VVA)), such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion dictated by a cam profile with a variable length mechanical, hydraulic or other linkage means. In a VVA lost motion (LM) system, a cam lobe may provide the "maximum" (longest dwell and greatest lift) motion needed for a full range of engine operating conditions. A variable length LM system may then be included in the valve train linkage, intermediate of the valve to be opened and the cam providing the maximum motion, to subtract or lose part or all of the motion imparted by the cam to the valve.

Unfortunately, although LM systems are beneficial in many aspects, they are also subject to several drawbacks. For example, in many current VVA LM systems, each valve in the engine requires its own hydraulic switching components (e.g., a so-called high speed solenoid valve) and associated electronics, resulting in added cost and complexity.

SUMMARY

The instant disclosure describes a system for actuating engine valves that overcomes the above-noted shortcomings. In an embodiment, in an engine comprising a cylinder having first and second engine valves of a same function type, a system for actuating the first and second engine valves comprises a first master piston that receives first valve actuation motions from a first valve actuation motion source and a second master piston that receives second valve actuation motions from a second motion source. The system further comprises a first slave piston operatively connected to the first engine valve and configured to hydraulically receive the first valve actuation motions from at least the first master piston. Additionally, the system comprises a second slave piston operatively connected to the second engine valve and configured to hydraulically receive the second valve actuation motions from the second master piston. The system further comprises an accumulator and a mode selector valve in hydraulic communication with the first master piston, the first slave piston and the accumulator. In operation, the mode selector valve may selectively hydraulically connect the first master piston to the accumulator.

In one embodiment, the system further comprises a hydraulic passage between the second master piston and the first slave piston such that the first slave piston hydraulically receives the second valve actuation motions from the second master piston via the hydraulic passage. In this embodiment, the mode selector valve may selectively hydraulically connect the first master piston to the first slave piston, or may selectively hydraulically connect the first master piston and the second master piston to the accumulator.

In another embodiment, the mode selector valve is in hydraulic communication with the hydraulic passage, and the system further includes a two-way valve disposed within the hydraulic passage in between the second master piston and the mode selector valve and further in hydraulic communication with the accumulator. In this embodiment, the two-way valve may selectively hydraulically connect the second master piston and the mode selector valve or selectively hydraulically connect the second master piston and the accumulator. In this embodiment, the first valve actuation motions provided by the first motion source may provide less peak valve lift than the second valve actuation motions provided by the second valve actuation motion source. Alternatively, or additionally, in this embodiment, the first valve actuation motions provided by the first motion source may be of shorter duration than the second valve actuation motions provided by the second valve actuation motion source.

In another embodiment, the first master piston is disposed in a first master piston bore having a spill port, and the mode selector valve may selectively hydraulically connect the spill port to the accumulator or may selectively hydraulically isolate the accumulator from the first master piston and the spill port.

In another embodiment, the first slave piston is disposed in a first slave piston bore having a spill port, and the mode selector valve may selectively hydraulically connect the spill port to the accumulator or may selectively hydraulically isolate the accumulator from the first master piston and the spill port.

In still further embodiments, the system may comprise a lock configured to selectively lock and unlock the first master piston in a deactivated position and/or the system may comprise, for each of the first and second slave pistons, an automatic lash adjuster operatively connected to the slave piston.

BRIEF DESCRIPTION OF THE DRAWINGS

The features described in this disclosure are set forth with particularity in the appended claims. These features and attendant advantages will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
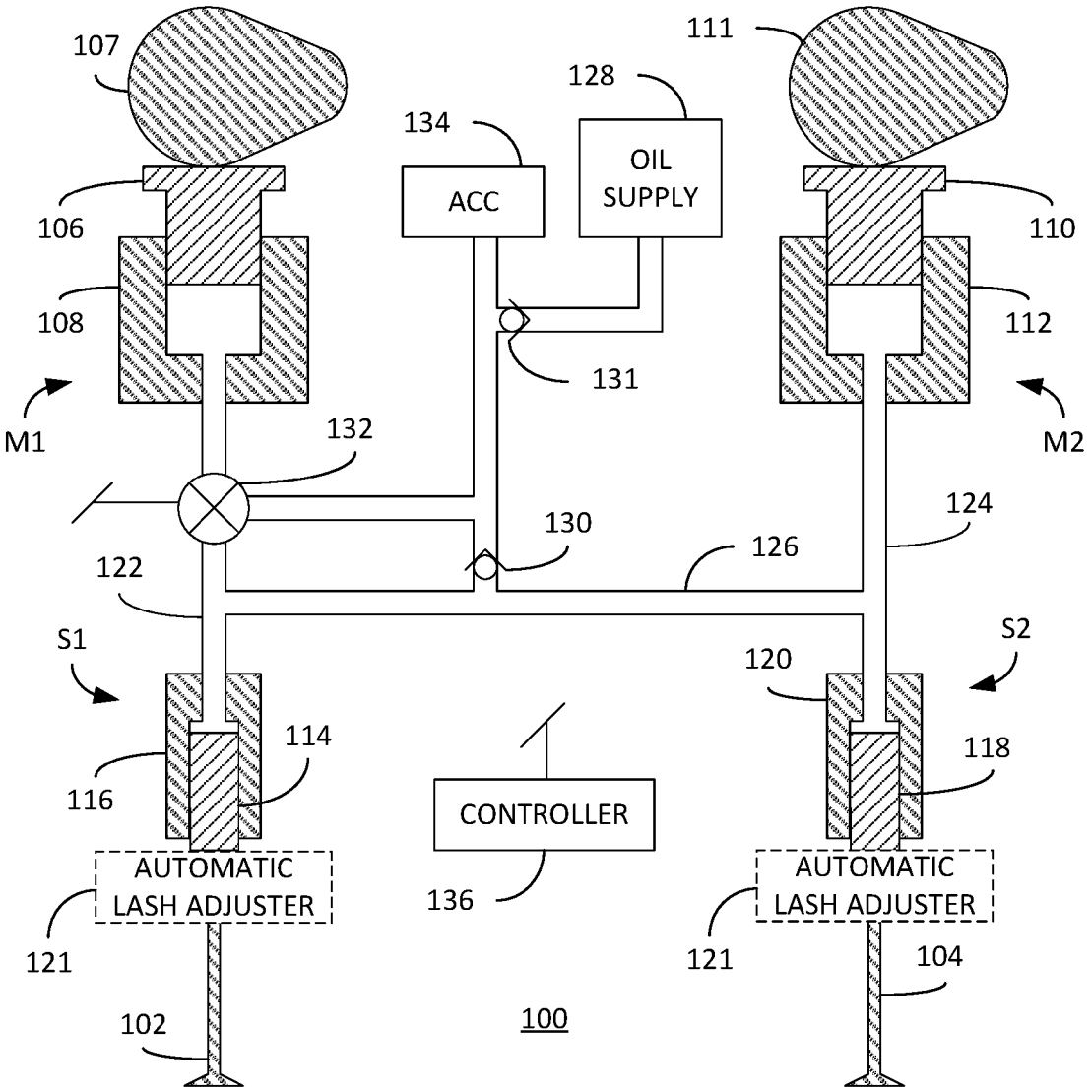
FIG. 1 is a schematic, partial cross-sectional block diagram of a system comprising a mode selector valve for actuating first and second engine valves in accordance with a first embodiment of the instant disclosure.

Referring now to FIG. 1, a system 100 for actuating first and second engine valves 102, 104 in accordance with a first embodiment comprises a first master piston assembly M1, a second master piston assembly M2, a first slave piston assembly S1 and a second slave piston assembly S2. In an embodiment, both the first and second engine valves 102, 104 are associated with a single engine cylinder (not shown) and both engine valves are of a same function type, i.e., they both perform the same function in terms of operation of an internal combustion engine which may consist of more than one engine cylinder where one or more cylinders may include the VVA systems herein described. For example, both the first and second engine valves may be intake valves or both may be exhaust valves. In an embodiment, the first master piston assembly M1 may comprise a first master piston 106 slidably disposed in a first master piston bore 108, and the second master piston assembly M2 may comprise a second master piston 110 slidably disposed in a second master piston bore 112. Similarly, the first slave piston assembly S1 may comprise a first slave piston 114 slidably disposed in a first slave piston bore 116 and the second slave piston assembly S2 may comprise a second slave piston 118 slidably disposed in a second slave piston bore 120. The first master piston 106 is configured to receive first valve actuation motions from a first valve actuation motion source 107 and the second master piston 110 is configured to receive second valve actuation motions from a second valve actuation motion source 111. In an embodiment, both the first and second master pistons 106, 110 are biased into contact with their respective first and second motion sources 107, 111. In the illustrated embodiment, the first and second valve actuation motion sources 107, 111 are illustrated as rotating cams having various cam lobes that induce movement of the master pistons. However, it is noted that the instant disclosure is not limited in this regard as the first and second valve actuation motion sources 107, 111 may be implemented using other components well-known to those having skill in the art.

As further shown, the first slave piston 114 is operatively connected the first engine valve 102, whereas the second slave piston 118 is operatively connected to the second engine valve 104. In this manner, the system 100 permits separate actuation of the first and second engine valves 102, 104 as described in further detail below. In an embodiment, each of the first and second slave pistons 114, 118 may be optionally connected to an automatic lash adjuster 121. As known in the art, such automatic lash adjusters 121 are beneficial to the extent that they may reduce or substantially eliminate any lash space between the slave pistons 114, 118 and their respective engine valves 102, 104. Suitable automatic lash adjusters 121 are well known to those having skill in the art.

In the embodiment of FIG. 1, the first master piston assembly M1 is in hydraulic communication with the first slave piston assembly S1 via a first hydraulic passage 122 and the second master piston assembly M2 is in hydraulic communication with the second slave piston assembly S2 via a second hydraulic passage 124. Additionally, the second master piston assembly M2 is also in hydraulic communication with the first slave piston assembly S1 via a third hydraulic passage 126. As further shown, hydraulic fluid, such as but not limited to engine oil, may be provided to the first, second and third hydraulic passages 122-126 as well as the first master piston bore 108, second master piston bore 112, first slave piston bore 116 and second slave piston bore 120 by a low-pressure oil supply 128 (e.g., an oil pump) via a check valve 130. In accordance with well-known hydraulic fluid principles, when the fluid passages 122-126 and the piston bores 108, 112, 116, 120 are charged with hydraulic fluid, the incompressibility of the hydraulic fluid permits valve actuation motions applied to the master pistons 106, 110 to be conveyed to and received by the slave pistons 114, 118, as will be described in further detail below.

The system 100 further comprises a mode selector valve 132 in fluid communication with the first master piston 106, the first slave piston 114 and an accumulator 134. In an embodiment, the accumulator 134 is configured to receive highly pressurized hydraulic fluid from the various hydraulic passages and/or piston bores. In particular, the volume of the accumulator 134 is sufficient to receive substantially all of the hydraulic fluid that may be displaced by the first and second master pistons 106, 112. In order to prevent hydraulic fluid directed to or from the accumulator 134 from also flowing toward the oil supply 128, an additional one-way valve 131 is provided between the accumulator 134 and oil supply 128. As further shown, the mode selector valve 132 is operatively connected to a controller 136, which controls operation of the mode selector valve 132. In an embodiment, the controller 136 may comprise a suitable processing device such as a microprocessor, microcontroller, digital signal processor, co-processor or the like or combinations thereof capable of executing stored instructions, or programmable logic arrays or the like, as embodied, for example, in an engine control unit (ECU). Depending on the implementation of the mode selector valve 132, the controller 136 may comprise other components used to control operation of the mode selector valve 132. For example, in various embodiments described below, the mode selector valve 132 is implemented as a multi-port, three-position spool valve. Consequently, the controller 136 may further comprise an electrically-controlled actuator used to control configuration of the spool valve. Alternatively, the mode selector valve may also consist of a series of poppet-type valves where the sequence of selecting the correct poppet valve is enabled to direct the hydraulic fluid to the appropriate location. In yet another alternative, the mode selector valve 132 may comprise an angular flow valve where rotary position of a circular valve operates to connect different ports enabling appropriate flow passages to be enabled. Those having skill in the art will appreciate that the instant disclosure is not limited by the particular implementation of the mode selector valve 132.

Figure 2:
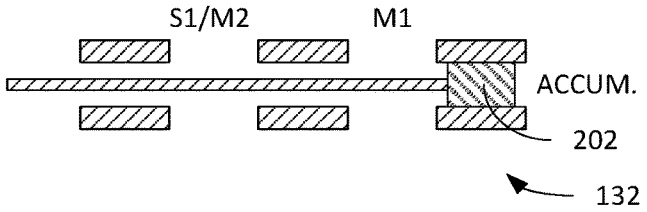
FIGS. 2-4 are schematic illustrations of the mode selector valve implemented as a three-port, three-position spool valve in accordance with the first embodiment of the system of FIG. 1.

Operation of the system 100 is controlled through operation of the mode selector valve 132 as further described with reference to the schematic illustrations of FIGS. 2-4 in which the mode selector valve 132 is implemented as a spool valve having three ports (ACCUM, M1 and S1/M2) and single land 202. In particular, in a first mode illustrated in FIG. 2, the land 202 of the spool valve is positioned such that it occludes the port leading to the accumulator 132 and simultaneously provides hydraulic communication between those ports leading to the first master piston assembly M1 and the first slave piston assembly S1/second master piston assembly M2. In this mode, the first, second and third hydraulic passages 122, 124, 126 are all in fluid communication with each other and otherwise isolated from the accumulator 134 by virtue of the check valve 130 and mode selector valve 132. Consequently, assuming equivalent lift profiles provided by the first and second valve actuation motion sources 107, 111, both the first and second engine valves 102, 104 are actuated by their respective slave pistons 114, 118 according to the maximum lift curve 502 illustrated in FIG. 5, i.e., both the first and second engine valves will experience lifts dictated by the maximum lifts provided by displacement of the first and second master pistons 106, 110.

Figure 3:
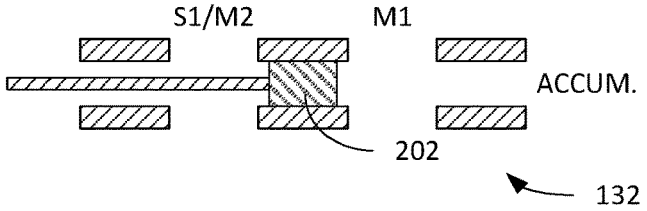

In a second mode illustrated in FIG. 3, the land 202 of the spool valve is positioned such that it hydraulically isolates the port leading to the first slave piston assembly S1/second master piston assembly M2 and simultaneously provides hydraulic communication between those ports leading to the first master piston assembly M1 and the accumulator 134. In this mode, the first and second slave pistons 114, 118 are all in fluid communication with only the second master piston 110 and otherwise isolated from the accumulator 134 by virtue of the check valve 130 and mode selector valve 132. Additionally, the first master piston 106 is in hydraulic communication with the accumulator 134. Consequently, any hydraulic fluid displaced by the first master piston 106 is routed to the accumulator 134 rather than the first slave piston 114. In effect, then, the first valve actuation motions applied to the first master piston 106 are lost to the accumulator 134. Furthermore, both the first and second engine valves 102, 104 are actuated by their respective slave pistons 114, 118 according to only the second valve actuation motions conveyed by the second master piston 110. Because the volume displaced by the second master piston 110 is now shared by the first and second slave piston assemblies S1, S2 (and further assuming equivalent bore volumes of the first and second slave piston bores 116, 120), the valves 102, 104 are actuated by their respective slave pistons 114, 118 according to the reduced lift curve 504 illustrated in FIG. 5.

Figure 4:
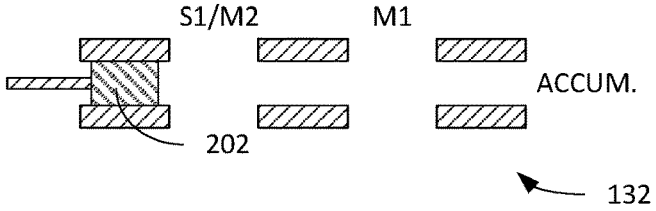
Figure 5:
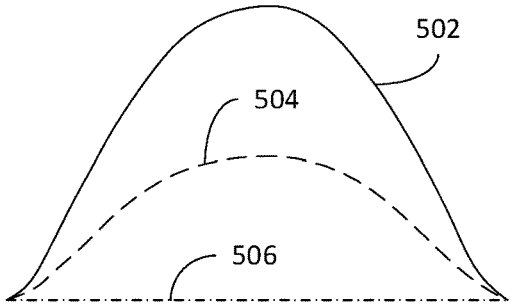
FIG. 5 illustrates examples of valve lifts for both the first and second engine valves that may be achieved in accordance with the first embodiment of the system of FIG. 1.

In a third mode illustrated in FIG. 4, the land 202 of the spool valve is positioned such that it provides hydraulic communication between those ports leading to the accumulator 134, the first master piston assembly M1 and the first slave piston assembly S1/second master piston assembly M2. In this mode, the first and second master pistons 106, 110 and the first and second slave pistons 114, 118 are all in fluid communication with the accumulator 134. Consequently, any hydraulic fluid displaced by both the first master piston 106 and the second master piston is routed to the accumulator 134 rather than the slave pistons 114, 118. In effect, then, the first and second valve actuation motions applied to the first and second master pistons 106, 110 are lost to the accumulator 134. Consequently, the valves 102, 104 are not provided any lift by their respective slave pistons 114, 118 according to the zero lift curve 506 illustrated in FIG. 5.

Figure 6:
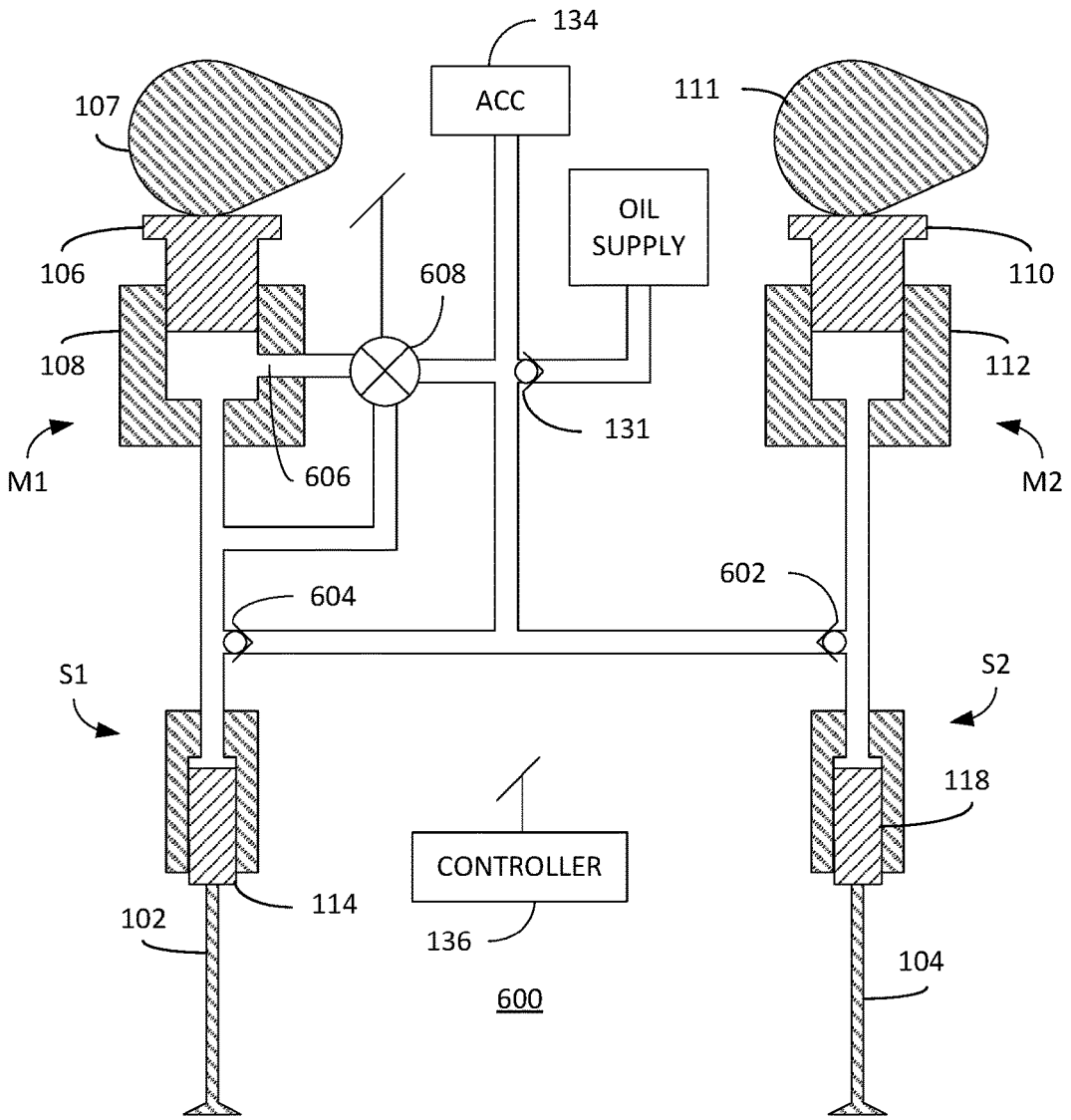
FIG. 6 is a schematic, partial cross-sectional block diagram of a system comprising a mode selector valve for actuating first and second engine valves in accordance with a second embodiment of the instant disclosure.
Figure 10:
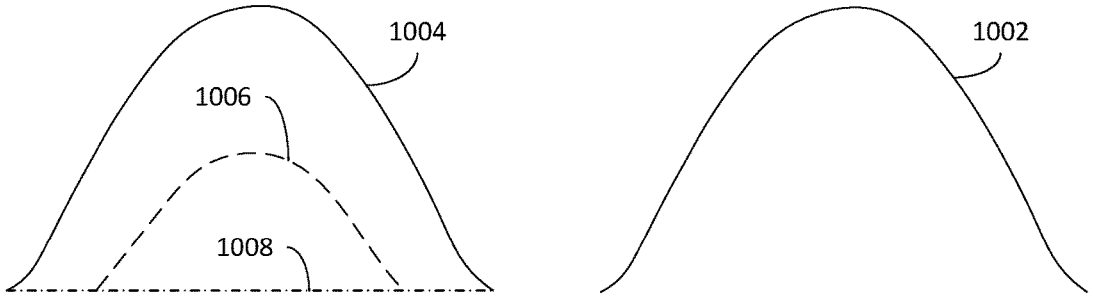
FIG. 10 illustrates examples of valve lifts that may be achieved in accordance with the second embodiment of the system of FIG. 6, wherein valve lifts for the first engine valve are depicted on the left of FIG. 10 and valve lifts for the second engine valve are depicted on the right of FIG. 10.

Referring now to FIG. 6, a system 600 in accordance with a second embodiment is illustrated comprising substantially identical first master piston assembly M1, second master piston assembly M2, first slave piston assembly S1 and second slave piston assembly S2 as described above relative to FIG. 1, with the below-described exceptions. In the system 600 of FIG. 6, the hydraulic passage between the second master piston assembly M2 and the second slave piston assembly S2 is hydraulically isolated from the rest of the system 600 by virtue of a check valve 602. Consequently, the valve lift experienced by the second engine valve 104 is dictated solely in all cases by the maximum lift provided by displacement of the second master piston 110. This is illustrated in FIG. 10 where the valve lifts of the second engine valve (right side of FIG. 10) is according to a maximum lift curve 1002.

As further shown in FIG. 6, the hydraulic passage between the first master piston assembly M1 and the first slave piston assembly S1 is hydraulically isolated by virtue of another check valve 604. Additionally, the first master piston bore 108 is provided with a spill port 606 positioned between the closed end of the first master piston bore 108 and that point where the first master piston 106 is fully extended out of the first master piston bore 108. A mode selector valve 608 (once again operated by the controller 136) is in fluid communication with the spill port 606, the first master piston 106 and the accumulator 134.

Figure 7:
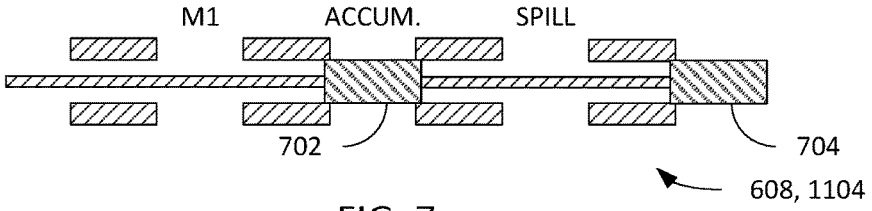
FIGS. 7-9 are schematic illustrations of the mode selector valve implemented as a three-port, three-position spool valve in accordance with the second embodiment of the system of FIG. 6.

Operation of the system 600 is controlled through operation of the mode selector valve 608 as further described with reference to the schematic illustrations of FIGS. 7-9 in which the mode selector valve 608 is implemented as a spool valve having three ports (ACCUM, M1 and SPILL) and first and second lands 702, 704. In particular, in a first mode illustrated in FIG. 7, the first and second lands 702, 704 of the spool valve are positioned such that the port leading to the accumulator 132 is occluded while also simultaneously hydraulically isolating those ports leading to the first master piston assembly M1 and the spill port 606. In this mode, the first master piston 106 is in hydraulic communication with the first slave piston 114 and any effect of the spill port 606 is eliminated. Consequently, the first engine valve 102 is actuated by its slave piston 114 according to the maximum lift curve 1004 illustrated in FIG. 10, i.e., the first engine valve will experience lifts dictated by the maximum lifts provided by displacement of the first master piston 106. It is noted that, as illustrated in FIG. 10, the maximum lift curves 1002, 1004 achieve the same maximum lift and have the same duration. In practice, however, this is not a requirement, i.e., the maximum lift curves 1002, 1004 for each valve may have different maximum lifts and/or different durations.

Figure 8:
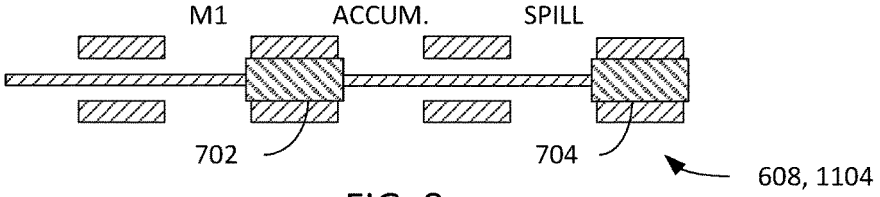

In a second mode illustrated in FIG. 8, the first and second lands 202 of the spool valve are positioned such that the ports leading to the accumulator 134 and the spill port 606 are in hydraulic communication with each other while simultaneously hydraulically isolating that port leading to the first master piston assembly M1. Consequently, as the first master piston 106 begins to slide into its bore 108 in accordance with the first valve actuation motions applied thereto, any hydraulic fluid displaced thereby initially flows through the spill port 606 and is routed to the accumulator 134 rather than the first slave piston 114, i.e., the first engine valve experiences zero lift. In effect, then, the initial phases of the first valve actuation motions applied to the first master piston 106 are lost to the accumulator 134. As the first master piston 106 continues to slide within its bore 108, the first master piston 106 eventually occludes the spill port 606, thereby discontinuing any flow of hydraulic fluid to the accumulator 134. Because the first master piston assembly M1 is also hydraulically isolated from the accumulator 134, continued displacement of hydraulic fluid by the first master piston 106 now induces movement in the first slave piston 114 and the first engine valve 102. As a result, the first engine valve 102 is actuated according to a reduced lift and reduced duration (late valve opening and early valve closing) curve 1006 as shown in FIG. 10. Selection of the location of the spill port 606 between the extremes of the first master piston bore 108 effectively dictates the reduced lift and reduced duration lift curve 1006; the closer the spill port 606 is to the closed end of the first master piston bore 108, the more the maximum lift will be reduced and the shorter the duration of the lift 1006.

Figure 9:
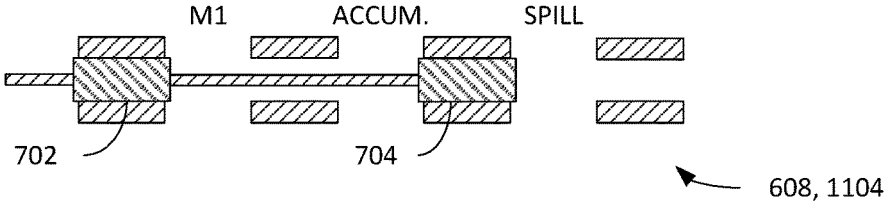

In a third mode illustrated in FIG. 9, the first and second lands 202 of the spool valve are positioned such that the ports leading to the accumulator 134 and the first master piston assembly M1 are in hydraulic communication with each other while simultaneously hydraulically isolating that port leading to the spill port 606. In this mode, the first master piston 106 is in fluid communication with the accumulator 134. Consequently, any hydraulic fluid displaced by the first master piston 106 is routed to the accumulator 134 rather than the first slave piston 114. In effect, then, the first valve actuation motions applied to the first master piston 106 is lost to the accumulator 134. Consequently, the first engine valve 102 is not provided any lift by its slave piston 114 according to the zero lift curve 1008 illustrated in FIG. 10.

Figure 11:
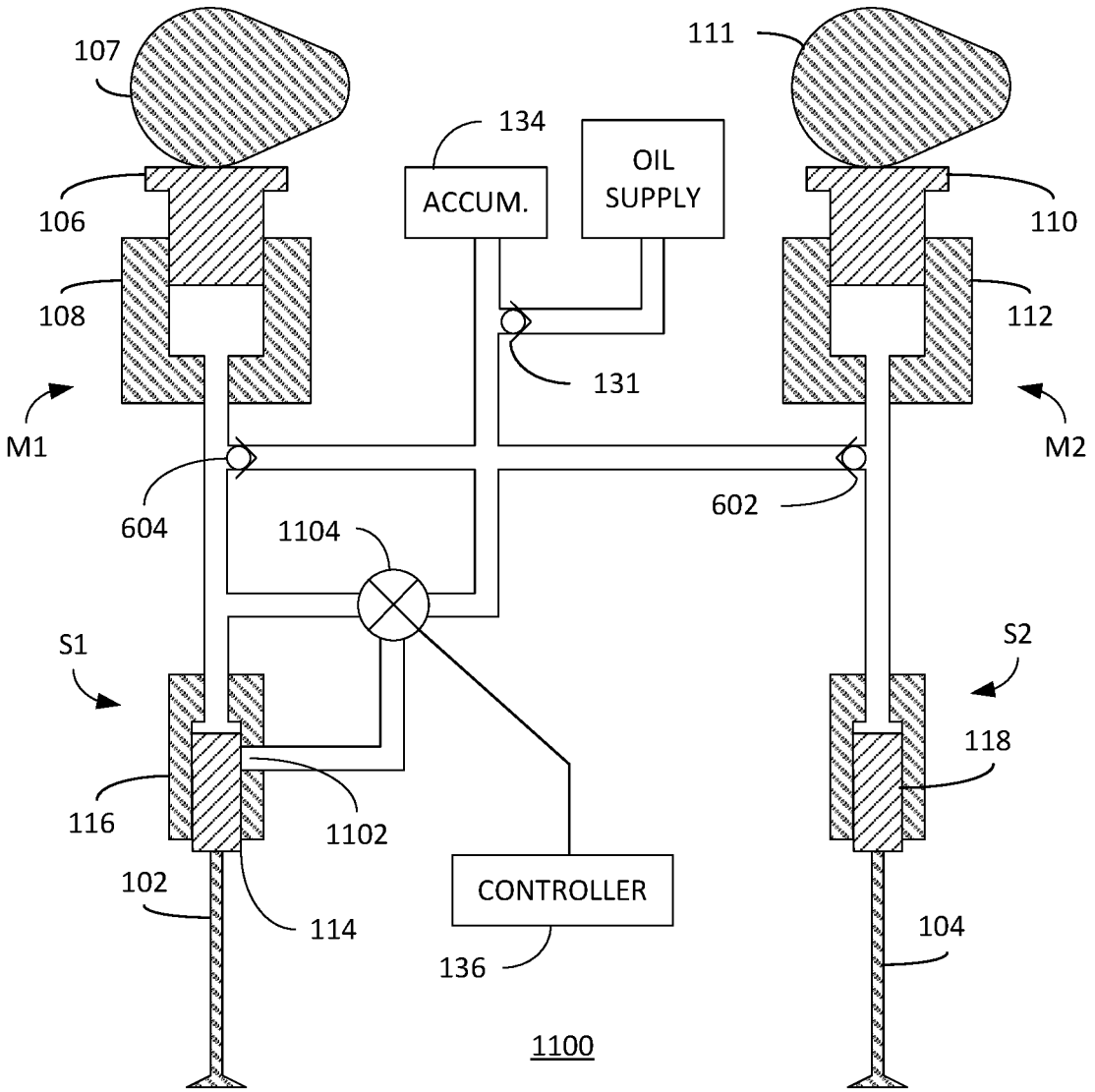
FIG. 11 is a schematic, partial cross-sectional block diagram of a system comprising a mode selector valve for actuating first and second engine valves in accordance with a third embodiment of the instant disclosure.
Figure 12:
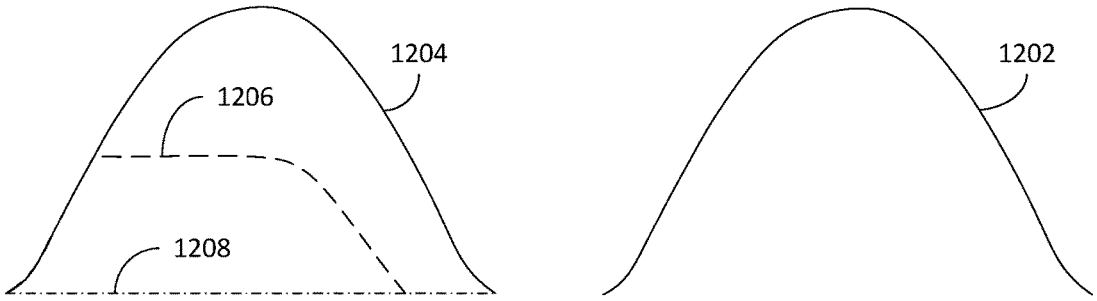
FIG. 12 illustrates examples of valve lifts that may be achieved in accordance with the first embodiment of the system of FIG. 11, wherein valve lifts for the first engine valve are depicted on the left of FIG. 12 and valve lifts for the second engine valve are depicted on the right of FIG. 12.

Referring now to FIG. 11, a system 1100 in accordance with a third embodiment is illustrated comprising substantially identical first master piston assembly M1, second master piston assembly M2, first slave piston assembly S1 and second slave piston assembly S2 as described above relative to FIGS. 1 and 6, with the below-described exceptions. In the system 1100 of FIG. 11, the hydraulic passage between the second master piston assembly M2 and the second slave piston assembly S2 is once again hydraulically isolated from the rest of the system 1100 by virtue of the check valve 602. Consequently, the valve lift experienced by the second engine valve 104 is dictated solely in all cases by the maximum lift provided by displacement of the second master piston 110. This is illustrated in FIG. 12 where the valve lifts of the second engine valve (right side of FIG. 12) is according to a maximum lift curve 1202.

As further shown in FIG. 11, the hydraulic passage between the first master piston assembly M1 and the first slave piston assembly S1 is hydraulically isolated by virtue of the other check valve 604. Additionally, the first slave piston bore 116 is provided with a spill port 1102 positioned between the closed end of the first slave piston bore 116 and that point where the first slave piston 114 is fully extended out of the first slave piston bore 116. A mode selector valve 1104 (once again operated by the controller 136) is in fluid communication with the spill port 1102, the first master piston 106 and the accumulator 134.

Equivalently to the system 600 of FIG. 6, operation of the system 1100 is controlled through operation of the mode selector valve 1104 as further described with reference to the schematic illustrations of FIGS. 7-9 in which the mode selector valve 1104 is implemented as a spool valve having three ports (ACCUM, M1 and SPILL) and first and second lands 702, 704. In particular, in the first mode illustrated in FIG. 7, the first and second lands 702, 704 of the spool valve are positioned such that the port leading to the accumulator 132 is occluded while also simultaneously hydraulically isolating those ports leading to the first master piston assembly M1 and the spill port 1102. In this mode, the first master piston 106 is in hydraulic communication with the first slave piston 114 and any effect of the spill port 1102 is eliminated. Consequently, the first engine valve 102 is actuated by its slave piston 114 according to the maximum lift curve 1204 illustrated in FIG. 12, i.e., the first engine valve will experience lifts dictated by the maximum lifts provided by displacement of the first master piston 106. It is once again noted that, as illustrated in FIG. 12, the maximum lift curves 1202, 1204 achieve the same maximum lift and have the same duration. In practice, however, this is not a requirement, i.e., the maximum lift curves 1202, 1204 for each valve may have different maximum lifts and/or different durations.

In the second mode illustrated in FIG. 8, the first and second lands 202 of the spool valve are positioned such that the ports leading to the accumulator 134 and the spill port 1102 are in hydraulic communication with each other while simultaneously hydraulically isolating that port leading to the first master piston assembly M1. Consequently, as the first slave piston 114 begins to slide out of its bore 116 in accordance with the first valve actuation motions received from the first master piston 106, the first engine valve 102 is likewise actuated according to the first valve actuation motions. So long as the first slave piston 114 occludes the spill port 1102, both the spill port 1102 and accumulator 134 have no effect on the valve actuation motions applied to the first engine valve 102. As the first slave piston 114 continues to slide within its bore 116, the first slave piston 114 eventually discontinues occluding the spill port 1102, thereby permitting flow of hydraulic fluid from the spill port 1102 to the accumulator 134, rather than the first slave piston 114. Consequently, so long as the spill port 1102 remains un-occluded, further advancement of the first slave piston 114 into the first slave piston bore 116 will be discontinued, effectively maintaining the first slave piston 114 at that position. In effect, then, that portion of the first valve actuation motions applied to the first slave piston 114 between the point where the first slave piston advances past the spill port 1102 and peak lift are partially lost to the accumulator 134. Following the peak lift point of the first valve actuation motions, i.e., as the first master piston once again extends out of its bore, the first slave piston 114 will once again slide back into the first slave piston bore 116 thereby closing the first engine valve 102 until such time as it is completely closed. Because the first slave piston 114 was never fully advanced in accordance with the peak lift of the first valve actuation motions, the first engine valve 102 will effectively close early, as illustrated by the reduced lift and reduced duration (early valve closing) curve 1206 as shown in FIG. 12.

In the third mode illustrated in FIG. 9, the first and second lands 202 of the spool valve are positioned such that the ports leading to the accumulator 134 and the first master piston assembly M1 are in hydraulic communication with each other while simultaneously hydraulically isolating that port leading to the spill port 1102. In this mode, the first master piston 106 is in fluid communication with the accumulator 134. Consequently, any hydraulic fluid displaced by the first master piston 106 is routed to the accumulator 134 rather than the first slave piston 114. In effect, then, the first valve actuation motions applied to the first master piston 106 is lost to the accumulator 134. Consequently, the first engine valve 102 is not provided any lift by its slave piston 114 according to the zero lift curve 1208 illustrated in FIG. 12.

Figure 13:
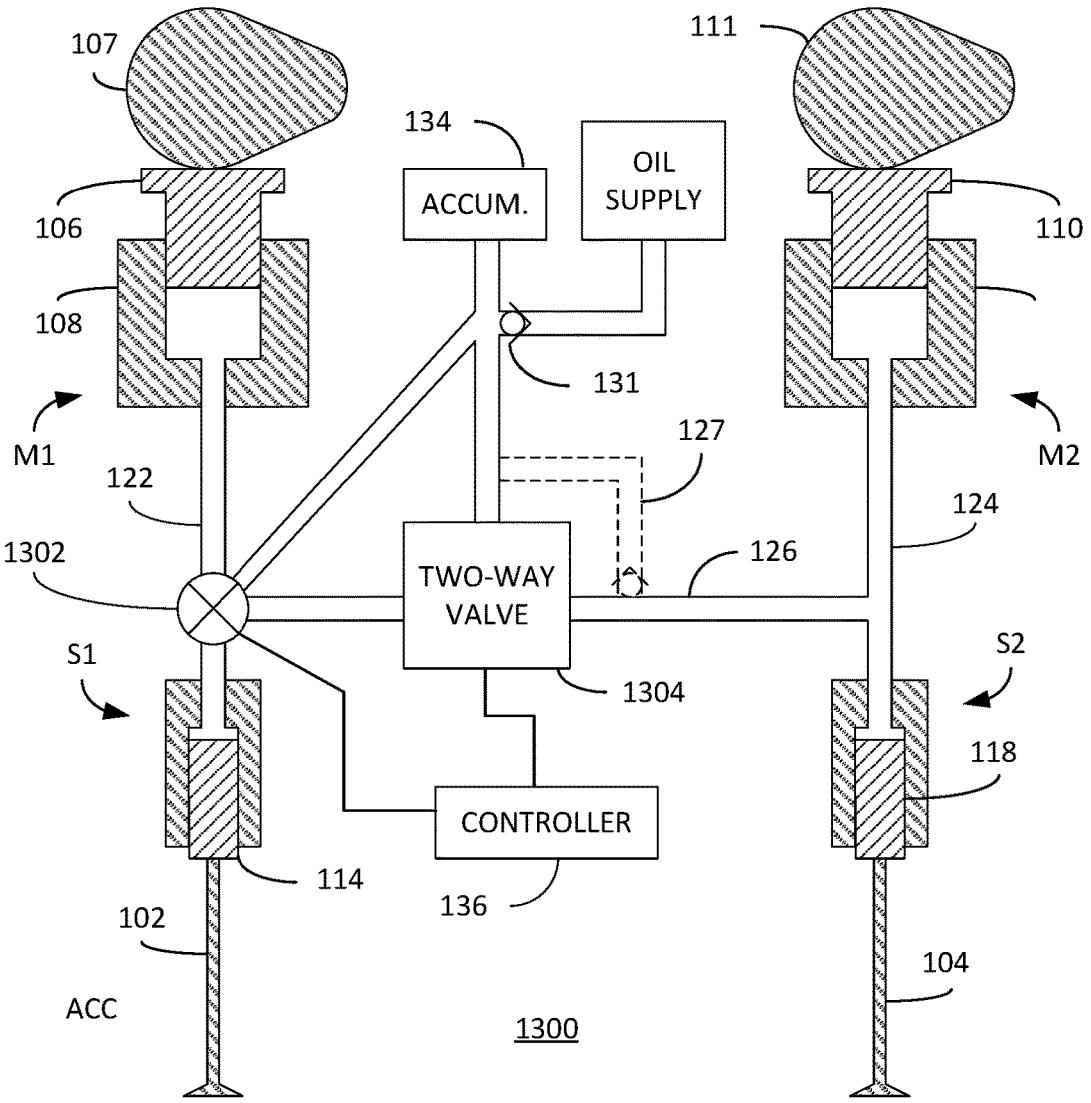
FIG. 13 is a schematic, partial cross-sectional block diagram of a system comprising a mode selector valve for actuating first and second engine valves in accordance with a fourth embodiment of the instant disclosure.

Referring now to FIG. 13, a system 1300 in accordance with a fourth embodiment is illustrated comprising substantially identical first master piston assembly M1, second master piston assembly M2, first slave piston assembly S1 and second slave piston assembly S2 as described above relative to FIGS. 1, 6 and 11, with the below-described exceptions. In the system 1300 of FIG. 13, the first, second and third hydraulic passages 122-126 are provided similar to the system 100 of the first embodiment. In this embodiment, however, a mode selector valve 1302 is provided in fluid communication with the third hydraulic passage 126 and, further, a two-way valve 1304 is disposed in the third hydraulic passage 126 between the second master piston assembly M2 and the mode selector valve 1302. As shown, the mode selector valve 1302, which operates under the control of the controller 136, is in fluid communication with the first master piston assembly M1, the accumulator 134, the third hydraulic passage 126 and the first slave piston assembly S1. The two-way valve 1304, which also operates under the control of the controller 136, is in fluid communication with the third hydraulic passage 126, the accumulator 134 and the mode selector valve 1302. Generally, the two-way valve may comprise any valve capable of quickly switching between two states, an example of which includes a so-called high speed solenoid valve (HSSV) as known to those having skill in the art. For example, in one implementation, the two-way valve comprises an HSSV configured to switch between a first state in which the HSSV provides fluid communication between the third hydraulic passage 126 and the mode selector valve 1302 while simultaneously hydraulically isolating the accumulator 134, and a second state in which the HSSV again provides fluid communication between the third hydraulic passage 126 and the mode selector valve 1302 while also providing fluid communication with the accumulator 134. In an embodiment, the two-way valve 1304 may provide the hydraulic fluid needed to charge the hydraulic passages and components illustrated in FIG. 13. Alternatively, as illustrated by the dashed lines, a bypass hydraulic passage 127 having a check valve disposed therein may be provided to supply the hydraulic passages and components.

Figure 14:
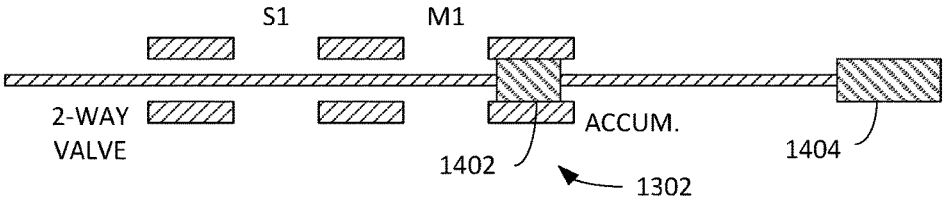
FIGS. 14-16 are schematic illustrations of the mode selector valve implemented as a four-port, three-position spool valve in accordance with the fourth embodiment of the system of FIG. 13.

Operation of the system 1300 is controlled through operation of the mode selector valve 1302 and the two-way valve 1304 as further described with reference to the schematic illustrations of FIGS. 14-16 in which the mode selector valve 1302 is implemented as a spool valve having four ports (ACCUM, M1, S1 and 2-WAY SWITCH) and first and second lands 1402, 1404, respectively. In particular, in a first mode illustrated in FIG. 14, the first land 1402 of the spool valve is positioned such that it occludes the port leading to the accumulator 132 and simultaneously provides hydraulic communication between those ports leading to the first master piston assembly M1, the first slave piston assembly S1 and the two-way valve 1304. At the same time, the two-way valve 1304 is controlled to be in the first state, i.e., providing hydraulic communication between the third hydraulic passage 126 and the mode selector valve 1302. In this mode, the first, second and third hydraulic passages 122, 124, 126 are all in fluid communication with each other and otherwise isolated from the accumulator 134 by virtue of the two-way valve 1304 and mode selector valve 1302. Consequently, assuming equivalent lift profiles provided by the first and second valve actuation motion sources 107, 111, both the first and second engine valves 102, 104 are actuated by their respective slave pistons 114, 118 according to the maximum lift curves 1702 illustrated in FIG. 17, i.e., both the first and second engine valves will experience lifts dictated by the maximum lifts provided by displacement of the first and second master pistons 106, 110.

Figure 17:
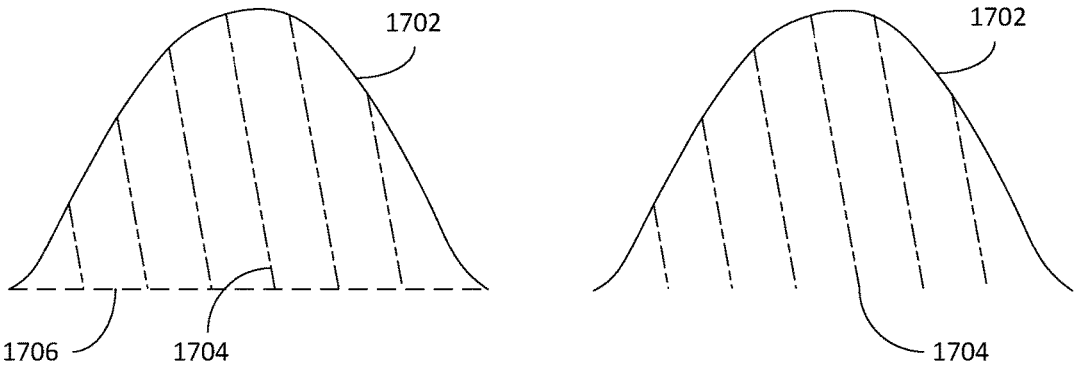
FIG. 17 illustrates examples of valve lifts that may be achieved in accordance with the fourth embodiment of the system of FIG. 13, wherein valve lifts for the first engine valve are depicted on the left of FIG. 17 and valve lifts for the second engine valve are depicted on the right of FIG. 17.

If, during this first mode, the two-way valve 1304 is controlled to operate in the second state, i.e., hydraulically connecting the third hydraulic passage 126, the mode selector valve 1302 and the accumulator 134, the pressurized fluid between the second master piston 110 and the second slave piston 118 and the first master piston 106 and the second slave piston 114 will vent toward the accumulator 134. Consequently, under the influence of their corresponding valve springs (not shown) the first and second engine valves 102, 104 will rapidly close as illustrated by the curves 1704 in FIG. 17. Multiple rapid valve closing curves 1704 are illustrated in FIG. 17 to illustrate the fact that the two-way valve 1304 may be controlled in this manner at virtually any point during the first and second valve actuation motions, thereby permitting a large degree of control over the closing time of the first and second engine valves 102, 104.

Figure 15:
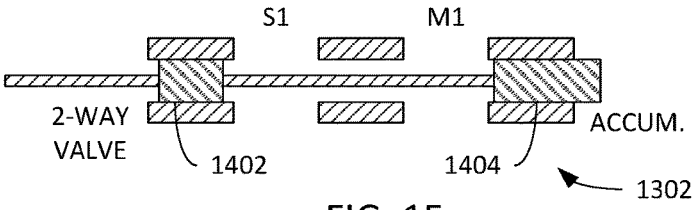

In a second mode illustrated in FIG. 15, the first land 1402 of the spool valve is positioned such that it hydraulically isolates the port leading to the two-way valve 1304 and the second land 1404 of the spool valve is position such that it hydraulically isolates the port leading to the accumulator 134. Furthermore, the positioning of the first and second lands 1402, 1404 provides hydraulic communication between those ports leading to the first master piston assembly M1 and the first slave piston assembly S1. At the same time, the two-way valve 1304 is controlled to be in the first state, i.e., providing hydraulic communication between the third hydraulic passage 126 and the mode selector valve 1302. In this mode, the first slave piston 114, is in fluid communication with the first master piston 106 and otherwise isolated from the accumulator 134 and the third hydraulic passage 126 by virtue of the mode selector valve 1302. Consequently, the first engine valve 102 is actuated by its corresponding first slave piston 114 according to the maximum lift curve 1702 illustrated in FIG. 17, i.e., the first engine valve will experience lifts dictated by the maximum lifts provided by displacement of the first master piston 106. At the same time, the configuration of the mode selector valve 1302 and the two-way valve 1304 similarly isolates the hydraulic connection between the second master piston 110 and the second slave piston 118 from the first hydraulic passage 122 and the accumulator 134. Consequently, the second engine valve 104 is actuated by its corresponding second slave piston 118 according to the maximum lift curve 1702 illustrated in FIG. 17, i.e., the second engine valve will experience lifts dictated by the maximum lifts provided by displacement of the second master piston 110.

If, during this second mode, the two-way valve 1304 is controlled to operate in the second state, i.e., hydraulically connecting the third hydraulic passage 126, the mode selector valve 1302 and the accumulator 134, the pressurized fluid between the second master piston 110 and the second slave piston 118 only will vent toward the accumulator 134. Consequently, under the influence of its corresponding valve spring (not shown) the second engine valve 104 will rapidly close as illustrated by the rapid closing curves 1704 on the right side of FIG. 17. Once again, multiple rapid valve closing curves 1704 are illustrated on the right side of FIG. 17 to illustrate the fact that the two-way valve 1304 may be controlled in this manner at virtually any point during the second valve actuation motion, thereby permitting a large degree of control over the closing time of the second engine valve 104. Note that, due to the continued isolation of the first hydraulic passage 122 from the two-way valve 1304 by virtue of operation of the mode selector valve 1302, the rapid closing curves 1704 are not experienced by the first engine valve 102 in this second mode.

Figure 16:
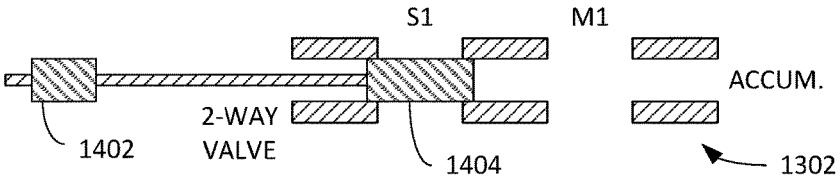

In a third mode illustrated in FIG. 16, the second land 1402 of the spool valve is positioned such that it provides hydraulic communication between those ports leading to the accumulator 134 and the first master piston assembly M1 while simultaneously hydraulically isolating those ports leading to the first slave piston assembly S1 and the two-way valve 1304. At the same time, the two-way valve 1304 is controlled to be in the first state, i.e., providing hydraulic communication between the third hydraulic passage 126 and the mode selector valve 1302. In this mode, the first master piston 106 is in fluid communication with the accumulator 134. Consequently, any hydraulic fluid displaced by the first master piston 106 is routed to the accumulator 134 rather than the first slave piston 114. In effect, then, the first valve actuation motions applied to the first master piston 106 are lost to the accumulator 134. Consequently, the first engine valve 102 is not provided any lift by its respective slave piston 114 according to the zero lift curve 1706 illustrated in FIG. 17. At the same time, the configuration of the mode selector valve 1302 and the two-way valve 1304 isolates the hydraulic connection between the second master piston 110 and the second slave piston 118 from the first hydraulic passage 122 and the accumulator 134. Consequently, the second engine valve 104 is actuated by its corresponding second slave piston 118 according to the maximum lift curve 1702 illustrated in FIG. 17, i.e., the second engine valve will experience lifts dictated by the maximum lifts provided by displacement of the second master piston 110.

If, during this third mode, the two-way valve 1304 is controlled to operate in the second state, i.e., hydraulically connecting the third hydraulic passage 126, the mode selector valve 1302 and the accumulator 134, the pressurized fluid between the second master piston 110 and the second slave piston 118 only will vent toward the accumulator 134. Consequently, under the influence of its corresponding valve spring (not shown) the second engine valve 104 will rapidly close as illustrated by the rapid closing curves 1704 on the right side of FIG. 17. Once again, multiple rapid valve closing curves 1704 are illustrated on the right side of FIG. 17 to illustrate the fact that the two-way valve 1304 may be controlled in this manner at virtually any point during the second valve actuation motion, thereby permitting a large degree of control over the closing time of the second engine valve 104. Note that, due to the continued isolation of the first hydraulic passage 122 from the two-way valve 1304 by virtue of operation of the mode selector valve 1302, the first engine valve 102 continues to experience the zero lift curve 1706 as described above.

Figure 18:
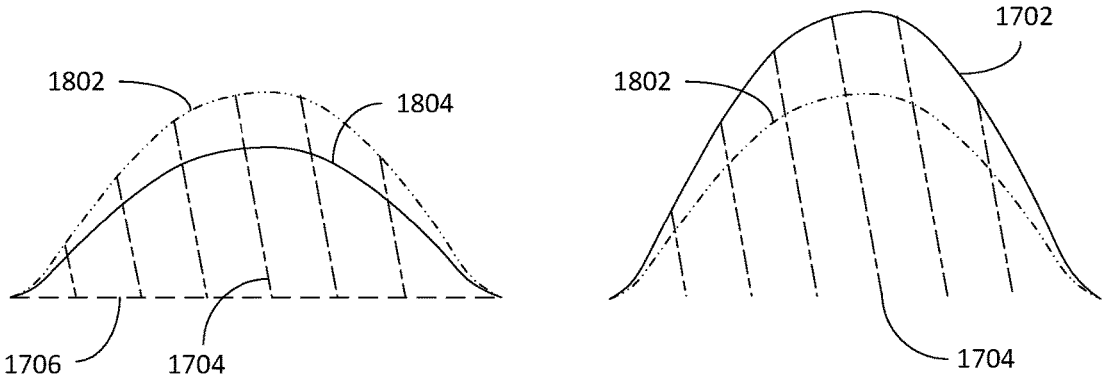
FIGS. 18 and 19 illustrate examples of valve lifts that may be achieved in accordance with variations of the fourth embodiment of the system of FIG. 13 wherein valve lifts for the first engine valve are depicted on the left of FIGS. 18 and 19, and valve lifts for the second engine valve are depicted on the right of FIGS. 18 and 19.

As best illustrated in FIG. 17, the description of operation of the system 1300 above assumes that the first and second valve actuation motion sources 107, 111 are equivalent in terms of maximum valve lift and valve lift duration, i.e., their maximum lift curves are identical. However, this is not a requirement. For example, in a first variation of the fourth embodiment shown in FIG. 13, it is assumed that the first valve actuation motion source 107 has the same valve lift duration as the second valve actuation motion source 111, but also has a lesser maximum valve lift than the second valve actuation motion source 111. In this first variation and in the first mode of the system 1300, both the first and second engine valves will experience a combination of the first and second valve actuation motions as illustrated by the first combined lift curve 1802. Once again, in this first mode, operation of the two-way valve 1304 can cause both the first and second engine valves 102, 104 to quickly switch to the rapid valve closing curves 1704 as shown in FIG. 18. In this first variation and the second mode of the system 1300, the first engine valve 102 will experience only the lower maximum lift of the first valve actuation motions as illustrated by the lower lift curve 1804 in FIG. 18. At the same time, the second engine valve 104 will experience the greater maximum lift of the second valve actuation motions as illustrated by the maximum lift curve 1702 shown in FIG. 18. Once again, in this second mode, operation of the two-way valve 1304 can cause only the second engine valve 102 to quickly switch to the rapid valve closing curve 1704 shown on the right of FIG. 18. Finally, in this first variation and in the third mode of the system 1300, the first engine valve will experience only the zero lift curve 1706 of FIG. 18, whereas the second engine valve will once again experience the same valve lifts (including the rapid valve closing curves 1702) as described above relative to the second mode.

Figure 19:
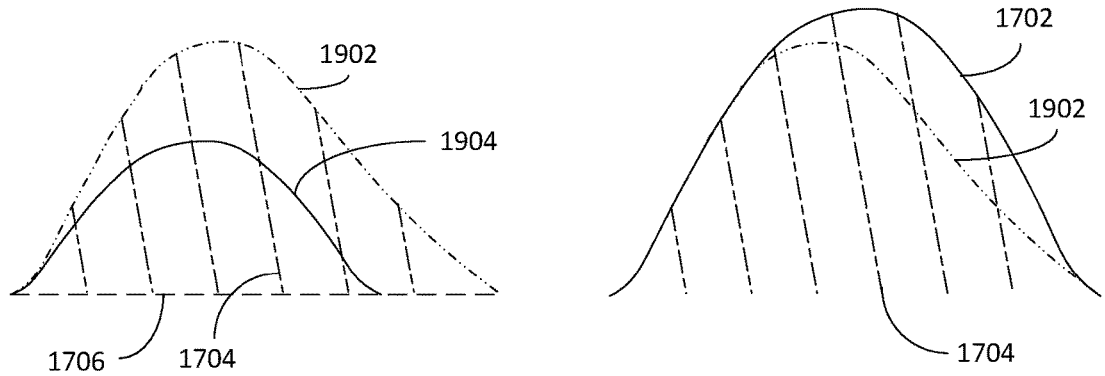

FIG. 19 illustrates a second variation of the fourth embodiment shown in FIG. 13 where it is assumed that the first valve actuation motion source 107 has a shorter valve lift duration (i.e., earlier valve closing) than the second valve actuation motion source 111 as well as a lesser maximum valve lift than the second valve actuation motion source 111. In this second variation and in the first mode of the system 1300, both the first and second engine valves will experience a combination of the first and second valve actuation motions as illustrated by the second combined lift curve 1902. Once again, in this first mode, operation of the two-way valve 1304 can cause both the first and second engine valves 102, 104 to quickly switch to the rapid valve closing curves 1704 as shown in FIG. 19. In this second variation and the second mode of the system 1300, the first engine valve 102 will experience only the shorter duration, lower maximum lift of the first valve actuation motions as illustrated by the shorter duration, lower lift curve 1904 in FIG. 19. At the same time, the second engine valve 104 will experience the greater duration and maximum lift of the second valve actuation motions as illustrated by the maximum lift curve 1702 shown in FIG. 19. Once again, in this second mode, operation of the two-way valve 1304 can cause only the second engine valve 102 to quickly switch to the rapid valve closing curve 1704 shown on the right of FIG. 19. Finally, in this second variation and in the third mode of the system 1300, the first engine valve will experience only the zero lift curve 1706 of FIG. 19, whereas the second engine valve will once again experience the same valve lifts (including the rapid valve closing curves 1702) as described above relative to the second mode.

Figure 20:
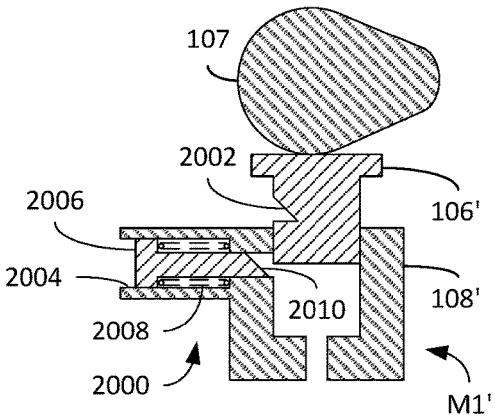
FIG. 20 is a schematic, cross-sectional diagram of a locking mechanism in accordance with an embodiment of the instant disclosure.

Finally, it is noted that the systems 100, 600, 1100, 1300 described above all include modes of operation in which the first valve actuation motions may be lost. In these instances, the continued actuation of the first master piston 106 by the first valve actuation motion source 107 leads to pumping losses that can be avoided through provision of a locking mechanism to prevent actuation of the first master piston 106 by the first valve actuation motion source 107. An example of this is illustrated in FIG. 20 where a modified first master piston assembly M1' includes a locking mechanism 2000. In this case, the first master piston 106' is modified to include a detent 2002 and the first master piston bore 108' is modified to include a transverse bore 2004, as illustrated. A transverse piston 2006 is slidably disposed in the transverse bore 2004. In the embodiment shown, the transverse piston 2004 is biased by a spring 2008 in a direction out of the transverse bore 2004, i.e., it is biased into a non-locking position. When it is desired to actuate the locking mechanism 2000 the transverse piston 2004 may be actuated, for example, through application of hydraulic fluid (via a hydraulic passage not shown) to the open end of the transverse bore 2004, i.e., opposite the bias spring 2008. Assuming the applied hydraulic fluid has sufficient pressure to overcome the bias spring 2008, the transverse piston 2006 will translate in the transverse bore 2004 (i.e., to the right as illustrated in FIG. 20) and into contact with the first master piston 106'. In an embodiment, an end of the transverse piston 2006 extending into the first master piston bore 108' is formed to have an incline surface 2010 relative to the direction of travel of the first master piston 106'. In this manner, contact between the inclined surface 2010 of the transverse piston 2006 and the first master piston 106' will permit the first master piston 106' to displace the transverse piston 2006 and continue its travel into the first master piston bore 108'. As the first master piston 106' continues into the first master piston bore 108', the detent 2002 will eventually align with the transverse piston 2006. At that point, the continued hydraulic pressure applied to the transverse piston 2006 will cause it to engage the detent 2002. So long as the hydraulic pressure is applied, the transverse piston 2006 will remain engaged with the detent 2002 thereby locking the first master piston 106' in a retracted position relative to the first valve actuation motion source 107, thereby avoiding pumping losses in those cases where the first valve actuation motions would otherwise be lost through operation of the accumulator 134. Thereafter, removal of the hydraulic fluid applied to the transverse piston 2006 once again allows the bias spring 2008 to displace the transverse piston 2006 out of the transverse bore 2008, thereby unlocking the first master piston 106'.

As described above, the systems 100, 600, 1100, 1300 of the instant disclosure provide VVA-type valve actuations (i.e., full lift, reduced lift, reduced duration, zero lift) that may be separately (differentially) applied to first and second engine valves without the need for dedicated components for each and every engine valve being controlled, thereby decreasing costs. Examples of the potential use of this system are described below. In an embodiment, the valve lifts provided by the instant disclosure can be used to enable enhancements to engine efficiency through increasing the charge air motion during the intake stroke thereby preventing the onset of knock in a spark ignited engine which enables the use of increased compression ratio, providing a thermodynamic efficiency improvement. Also, they can be used to substitute the intake restriction associated by the throttle in the intake thereby reducing the pumping loss of the engine resulting in increased brake efficiency. Further advantages may be generated by positioning these systems on the exhaust valves where the differential opening may provide variable excitation to the turbine of a turbocharger enabling increased excitation of the turbine to reduce turbo lag. As this can be performed on a single valve, additional control of the blowdown event can be implemented minimizing the loss in engine efficiency due to reduced expansion in the cylinder. It can also be used to provide increased thermal energy into the aftertreatment system where one exhaust valve of the system may be directed towards the aftertreatment system and the other port towards the turbocharger, thereby reducing the time taken to heat the aftertreatment system to a temperature for effective conversion of the exhaust gas. For at least these reasons, the above-described techniques represent an advancement over prior art teachings.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. An engine comprising a cylinder having a first engine valve and a second engine valve, and a system for actuating the first and second engine valves, the system comprising:

a first master piston configured to receive first valve actuation motions from a first motion source;

a second master piston configured to receive second valve actuation motions from a second motion source;

a first slave piston operatively connected to the first engine valve and configured to hydraulically receive the first valve actuation motions from at least the first master piston;

a second slave piston operatively connected to the second engine valve and configured to hydraulically receive the second valve actuation motions from the second master piston;

a hydraulic passage providing hydraulic communication between the second master piston and the first slave piston, wherein the first slave piston hydraulically receives the second valve actuation motions from the second master piston via the hydraulic passage;

an accumulator; and a mode selector valve in hydraulic communication with the first master piston, the first slave piston and the accumulator, where in the mode selector valve is operable to selectively hydraulically connect the first master piston to the accumulator, wherein the first and second engine valves are either both intake valves or both exhaust valves.

2. The system of claim 1, wherein the mode selector valve is operable to selectively hydraulically connect the first master piston to the first slave piston.

3. The system of claim 1, wherein the mode selector valve is operable to selectively hydraulically connect the first master piston and the second master piston to the accumulator.

4. The system of claim 1, wherein the mode selector valve is in hydraulic communication with the hydraulic passage, the system further comprising:

a two-way valve disposed within the hydraulic passage in between the second master piston and the mode selector valve and further in hydraulic communication with the accumulator, the two-way valve operable to selectively hydraulically connect the second master piston and the mode selector valve or to selectively hydraulically connect the second master piston, the mode selector valve and the accumulator.

5. The system of claim 4, wherein the first valve actuation motions provided by the first motion source provide less peak valve lift than the second valve actuation ions provided by the second valve actuation motion source.

6. The system of claim 4, wherein the first valve actuation motions provided by the first motion source are of shorter duration than the second valve actuation motions provided by the second valve actuation motion source.

7. The system of claim 1, further comprising:

a lock configured to selectively lock and unlock the first master piston in a deactivated position.

8. The system of claim 1, further comprising:

for each of the first and second slave pistons, an automatic lash adjuster operatively connected to the slave piston.

9. An engine comprising a cylinder having a first engine valve and a second engine valve, and a system for actuating the first and second engine valves, the system comprising:

a first master piston configured to receive first valve actuation motions from a first motion source;

a second master piston configured to receive second valve actuation motions from a second motion source;

a first slave piston operatively connected to the first engine valve and configured to hydraulically receive the first valve actuation motions from at least the first master piston;

a second slave piston operatively connected to the second engine valve and configured to hydraulically receive the second valve actuation motions from the second master piston;

an accumulator; and a mode selector valve in hydraulic communication with the first master piston, the first slave piston and the accumulator, where in the mode selector valve is operable to selectively hydraulically connect the first master piston to the accumulator, wherein the first and second engine valves are either both intake valves or both exhaust valves, and wherein the first master piston is disposed in a first master piston bore having a spill port, wherein a first slave piston is disposed in a first slave piston bore, and wherein the mode selector valve is operable to selectively hydraulically connect the spill port to the accumulator.

10. The system of claim 9, wherein the mode selector valve is operable to selectively hydraulically isolate the accumulator from the first master piston and the spill port.

11. An engine comprising a cylinder having a first engine valve and a second engine valve, and a system for actuating the first and second engine valves, the system comprising:

a first master piston configured to receive first valve actuation motions from a first motion source;

a second master piston configured to receive second valve actuation motions from a second motion source;

a first slave piston operatively connected to the first engine valve and configured to hydraulically receive the first valve actuation motions from at least the first master piston;

a second slave piston operatively connected to the second engine valve and configured to hydraulically receive the second valve actuation motions from the second master piston;

an accumulator; and a mode selector valve in hydraulic communication with the first master piston, the first slave piston and the accumulator, where in the mode selector valve is operable to selectively hydraulically connect the first master piston to the accumulator, wherein the first and second engine valves are either both intake valves or both exhaust valves, wherein the first slave piston is disposed in a first slave piston bore having a spill port, wherein a first master piston is disposed in a first master piston bore, and wherein the mode selector valve is operable to selectively hydraulically connect the spill port to the accumulator.

12. The system of claim 11, wherein the mode selector valve is operable to selectively hydraulically isolate the accumulator from the first master piston and the spill port.

* * * * *